United States Patent [19]

Richter

[11] Patent Number: 4,685,257

[45] Date of Patent: Aug. 11, 1987

[54] SHELTER ROOF STRUCTURE

[75] Inventor: Donald L. Richter, Rolling Hills Estates, Calif.

[73] Assignee: Temcor, Torrance, Calif.

[21] Appl. No.: 732,590

[22] Filed: May 10, 1985

[51] Int. Cl.[4] ..... E04B 1/34

[52] U.S. Cl. ..... 52/73; 52/80

[58] Field of Search ..... 52/80, 82, 73, 81, 15

[56] References Cited

U.S. PATENT DOCUMENTS

| | | | |
|---|---|---|---|
| 2,912,940 | 11/1959 | Baroni | 52/80 |
| 3,014,558 | 12/1961 | Noyes | 52/73 |
| 3,058,550 | 10/1962 | Richter | 52/80 |
| 3,063,519 | 11/1962 | Richter . | |
| 3,092,932 | 6/1963 | Wilson | 52/80 |
| 3,186,128 | 6/1965 | Charles | 52/80 |
| 3,206,895 | 9/1965 | DeRidder | 52/15 |
| 3,727,356 | 4/1973 | Appenzeller | 52/82 |
| 3,958,375 | 5/1976 | Tully | 52/80 |
| 4,115,963 | 9/1978 | Lubov | 52/81 |
| 4,180,950 | 1/1980 | Foster | 52/81 |

FOREIGN PATENT DOCUMENTS

| | | | |
|---|---|---|---|
| 739143 | 7/1966 | Canada | 52/81 |
| 1120195 | 4/1956 | France | 52/80 |
| 1262098 | 4/1961 | France | 52/80 |
| 1363720 | 5/1964 | France | 52/80 |

OTHER PUBLICATIONS

Interbuild, Jan. 1963, p. 32.

*Primary Examiner*—John E. Murtagh

*Attorney, Agent, or Firm*—Christie, Parker & Hale

[57] ABSTRACT

A roof structure is composed of a plurality of prefabricated formed metal saddle elements which have four sides and which are bent along a diagonal between nonadjacent corners to define two triangular portions having corners opposite the bend line and lying in planes inclined to each other. The roof also includes half saddles similar to one triangular portion of a full saddle. The saddles and half saddles are connected to define plural pyramids having four sides and quadrilateral bases. A basal corner of a pyramid is connected to the basal corners of no more than three other pyramids. Depending upon the nature and location of supports for the roof, struts may be connected between some but not all of the pyramids adjacent their apices; in some instances, no struts are required.

32 Claims, 19 Drawing Figures

12
29
30
32
38
25
48
46
47
45
28
51

SHELTER ROOF STRUCTURE

FIELD OF THE INVENTION

The invention pertains to roof structures. More particularly, it pertains to a roof structure of the canopy type in which a plurality of prefabricated geometric forms are interconnected, supported and stayed to provide a shelter useful in connection with transport system stations, among other diverse uses.

BACKGROUND OF THE INVENTION

The Nature of the Need Addressed

There are many different situations presented where canopy-type roof structures are useful to provide a covering over an area. Transport system stations, such as rail or bus stations, shopping malls, and airport access and egress areas are examples of such areas. In such places, the roof structure could provide unrestricted lateral access and a covering to protect people and things from weather or, if desired, the covered area could be enclosed on one or all sides with protected access.

Such roof structures should be strong, aesthetically attractive, weatherproof, as free from maintenance requirements as possible, and structurally efficient. Also, it is desirable that they be capable of being erected rapidly, preferably with relatively unskilled labor and minimal heavy equipment. Prefabrication of the elements of the roof is desirable for purposes of quality assurance, economics, and ease of erection.

This invention provides a novel, aesthetic, structurally strong and efficient, and low maintenance roof structure which has major elements which can be prefabricated. The roof is easily assembled, and has many other desirable properties. It is modular in design concept, and so can be used to cover areas of varying size and geometry by suitable repetition of modules.

Review of the Prior Art

The present roof structure involves an unobvious and innovative extension and application of certain aspects of the structures described in my U.S. Pat. Nos. 3,026,651 and 3,058,550, the latter being a division of the former. Those patents pertain to a formed sheet metal structural element and to the construction of space-enclosing domes made of a plurality of such elements. Each element is formed, by suitable bending and forming processes, into a four-cornered three-dimensional saddle-like element which is formed essentially symmetrically about a long axis between first nonadjacent corners and which has a strut or stay connected along a short axis of the element between its other two nonadjacent corners to define a structural combination which has the structural properties of a tetrahedronal frame. The long axis lies along a valley of the element which divides the element into its two similar triangular portions, and the strut or stay is connected between the tips of those triangular portions. Saddle-shaped units cut on the long diagonal (half units) are also used to terminate and tie the roof edge.

These prior patents teach that the tetrahedronal strut and sheet element assemblies are interconnected to form a geodesic dome of generally spherical contour with locally pyramidal geometry. The dome is geodesic in nature in that the valleys of the interconnected assemblies are aligned on geodesic lines across the spherical curvature of the dome. The several assemblies are so interconnected that each long axis end of each element is connected to a similar end of four or five other elements, and the triangular portion of each element cooperates with the similar portions of two other elements to define a three-sided pyramid or tetrahedron. Each face of each pyramid, near or at the pyramid apex, has a strut connected to it. The structure of the dome is defined essentially exclusively by the interconnected strut and sheet assemblies.

I have now discovered that the subject matter described in my prior U.S. patents, identified above, is a special case of a heretofore unrecognized broader invention which is unsuggested by, and is actually obscured by the disclosures of those patents. I have discovered that where saddle-like elements generally similar to those described in my prior patents are defined to be assemblable into pyramids having four sides, so that the pyramid base is a polygon having four sides, and depending upon the nature and location of supports, a roof structure can be provided having either no struts interconnecting pyramid apices or minimal struts between pyramid apices. The roof structure, subject to having local pyramidal configuration, can be flat overall or can have any curvature desired and practical.

This discovery enables the prefabricated manufacture, under efficient conditions, of diverse roof structures which are strong, aesthetically attractive, weatherproof, have low maintenance requirements, and which can be readily assembled in the field to cover areas of widely varying size or shape. Thus, this invention directly addresses and meaningfully satisfies the needs described above.

SUMMARY OF THE INVENTION

Generally speaking, this invention provides a roof structure which is comprised of a plurality of stressed skin saddle-like three-dimensional four-cornered structural units. Each unit has a first axis extending between nonadjacent basal corners of the unit, the axis lying along a valley which divides the unit into two substantially triangular portions. Each unit has peripheral connection edges extending between adjacent corners. Each unit has nonadjacent apical corners spaced from the valley at the tips of the unit's triangular portions. The four corners of each unit are disposed out of a common plane. The several units of the roof structure are connectible to each other along their connection edges, and also at their corners, in a predetermined relation in plural groups of four units per group. The units in each group are configured so that upon connection their first axes define a polygon having four sides and the units in each group cooperate to define a pyramid having four sides with an apex formed by the interconnection of the apical corners of the units in the group. Support means are connectible to the roof structure at selected points for supporting the structure.

Depending upon the nature of the support means, and the number and location of the points where the support means are connectible to the structure, strut means may be required to be connected between the apices of selected adjacent pyramids to provide stability to the structure. Where strut means are present, they are connected between less than all of the adjacent pyramids.

The overall curvature of the roof structure, ignoring the local pyramid configurations, can be flat or of any other curvature desired consistent with practical considerations. Thus, the overall roof curvature can be generally spherical or any shape of single or double curvature.

DESCRIPTION OF THE DRAWINGS

The above-mentioned and other features of this invention are more fully set forth in the following description of certain presently preferred embodiments of the invention, which description is presented with reference to the accompanying drawings wherein.

DESCRIPTION OF THE ILLUSTRATED EMBODIMENTS

Figure 3:
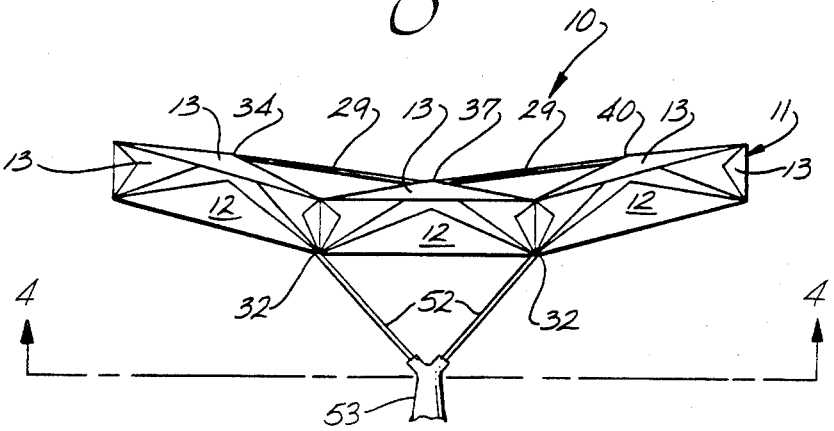
FIG. 3 is a side elevation view taken along line 3—3 in FIG. 2.
Figure 4:
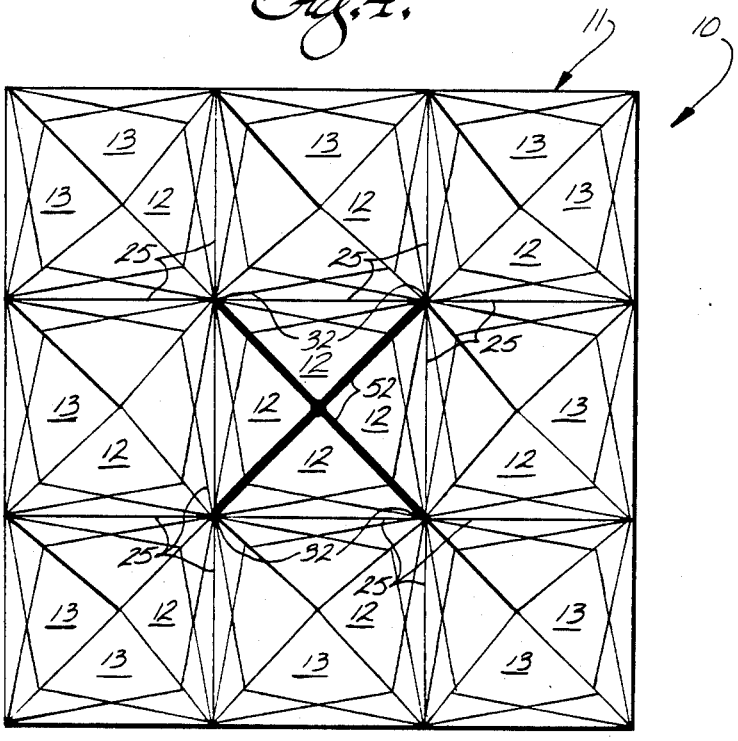
FIG. 4 is a bottom view taken along line 4—4 in FIG. 3.
Figure 5:
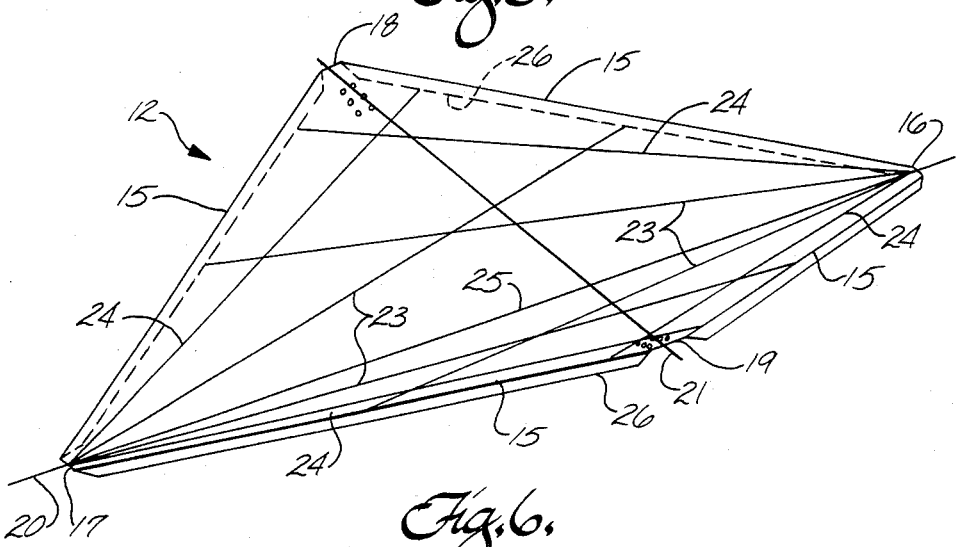
FIG. 5 is a perspective view of a saddle-like unit used in the construction of the roof structure shown in FIG. 1.
Figure 6:
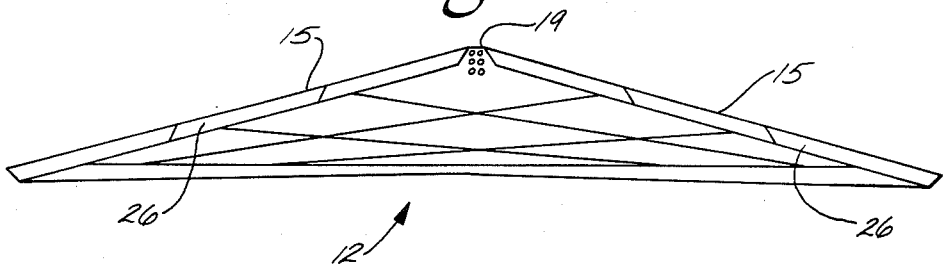
FIG. 6 is a side elevation view of the unit shown in FIG. 5.
Figure 7:
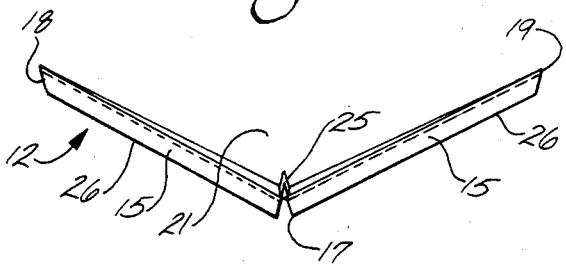
FIG. 7 is an end view of the unit of FIG. 5.

FIGS. 1–4 show a roof structure 10 which has an overall square plan perimeter 11 and which is defined by a plurality of similar saddle-like, four-cornered structural units, a representative such unit 12 being shown in FIGS. 5–7. Unit 12 is representative of the other saddle-like units in roof 10 in that it is geometrically similar to them and has the same essential structural features and properties as the others. There are twelve complete units 12 in roof 10 and twelve half-unit constructions 13 in the roof, the latter being present to define perimeter 11.

The side elevation view of FIG. 3 is a view of any side of roof 10. A close inspection of FIGS. 1–4 reveals that the overall configuration of the roof is spherically concave upward, rather than flat. Therefore, the several full saddle-like units 12 are not identical to each other throughout the roof, nor are the several half-units 13 identical to each other. Rather, they are geometrically similar to others of their kind.

As shown in FIG. 5, a complete saddle-like unit 12 (hereinafter called simply a "saddle" or "saddle element") preferably is formed of sheet metal, aluminum being preferred, which has been cut in a flat state to the desired unfabricated shape, drilled as required for pertinent connections, and then bent, as in a plate brake, to the desired finished contour having edge flanges and strengthening creases, which features are common to the several complete saddles and, in part, to the half-saddle units 13. Thus, each saddle 12 has a roughly quadrilateral overall shape having edges 15 extending between the four corners of the saddle. The corners are first nonadjacent corners 16 and 17 and second nonadjacent corners 18 and 19. Corners 16 and 17, denominated as basal corners, lie at opposite ends of a valley 21 (see FIG. 7) which extends across the saddle along an axis 20. In the saddles 12 for roof 10, axis 20 is an axis of symmetry of the saddle, but as will be seen, a saddle need not be symmetrical about its valley axis in some embodiments of this invention. In saddles 12, a line 21 between corners 18 and 19 is also an axis of symmetry of the saddle.

The valley axis 20 divides saddle 12 into two triangular portions each of which has two edges 15 and one of corners 18, 19 at its tip remote from the valley. Ultimately corners 18, 19 of the several saddles cooperate to form the apices of pyramids in roof 10, and so these corners are denominated as apical corners of the saddle.

As shown in FIGS. 5 and 6, a desired degree of curvature is imparted to the sheet materal of saddle 12 by the formation of a series of creases or bends in the sheet. These creases include a pair of creases 23 and preferably at least a pair of creases 24 in each triangular portion of the saddle. All creases radiate from the saddle's basal corners, with the same number of creases radiating from one basal corner as the other basal corner. Creases 23 are closest to valley 21 and cooperate to form a diamond pattern along the valley. Corresponding ones of the other creases also have diamond patterns of greater minor diagonal dimension in the saddle. The creases are formed in such numbers and in such locations in the saddle as are desired to impart the desired contour to the saddle and to provide the desired structural stiffening characteristics. The creases cooperate to give the saddle a contour which roughly approximates a mathematical saddle. Thus, as shown in FIG. 6, a line along the saddle valley between the basal corners is not a straight line, but has its center located above a truly straight line between the basal corners.

If desired, a rib 25 may be formed in the saddle material at the base of valley 21 to extend between the basal corners; see FIG. 7. Such a rib adds structural strength.

After creases 23 and 24, and rib 25 if provided, have been formed, depending flanges 26 are formed in the saddle material to define edges 15 which preferably are straight but are not required to be straight in all embodiments of this invention. Edges 15 are connection edges in the saddle by which the saddle is connected to other saddles in roof 10 by use of rivets, bolts or similar fasteners passed through suitable holes in the abutting flanges.

A half-saddle 13 useful in the practice of this invention corresponds to.a single trangular portion of a full saddle 12. A blank for the manufacture of a half saddle is essentially a blank for a full saddle cut in half along a line between the basal corners of the full saddle blank. A half-saddle 13 does not include a feature corresponding to rib 25 of a full saddle 12.

Saddles 12 are generally in accord with the descriptions of U.S. Pat. No. 3,026,651 to which reference may be made.

Figure 8:
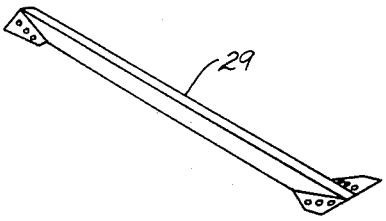
FIG. 8 is a perspective view of a strut member useful in the roof structure of FIG. 1.
Figures 9, 10, 11:
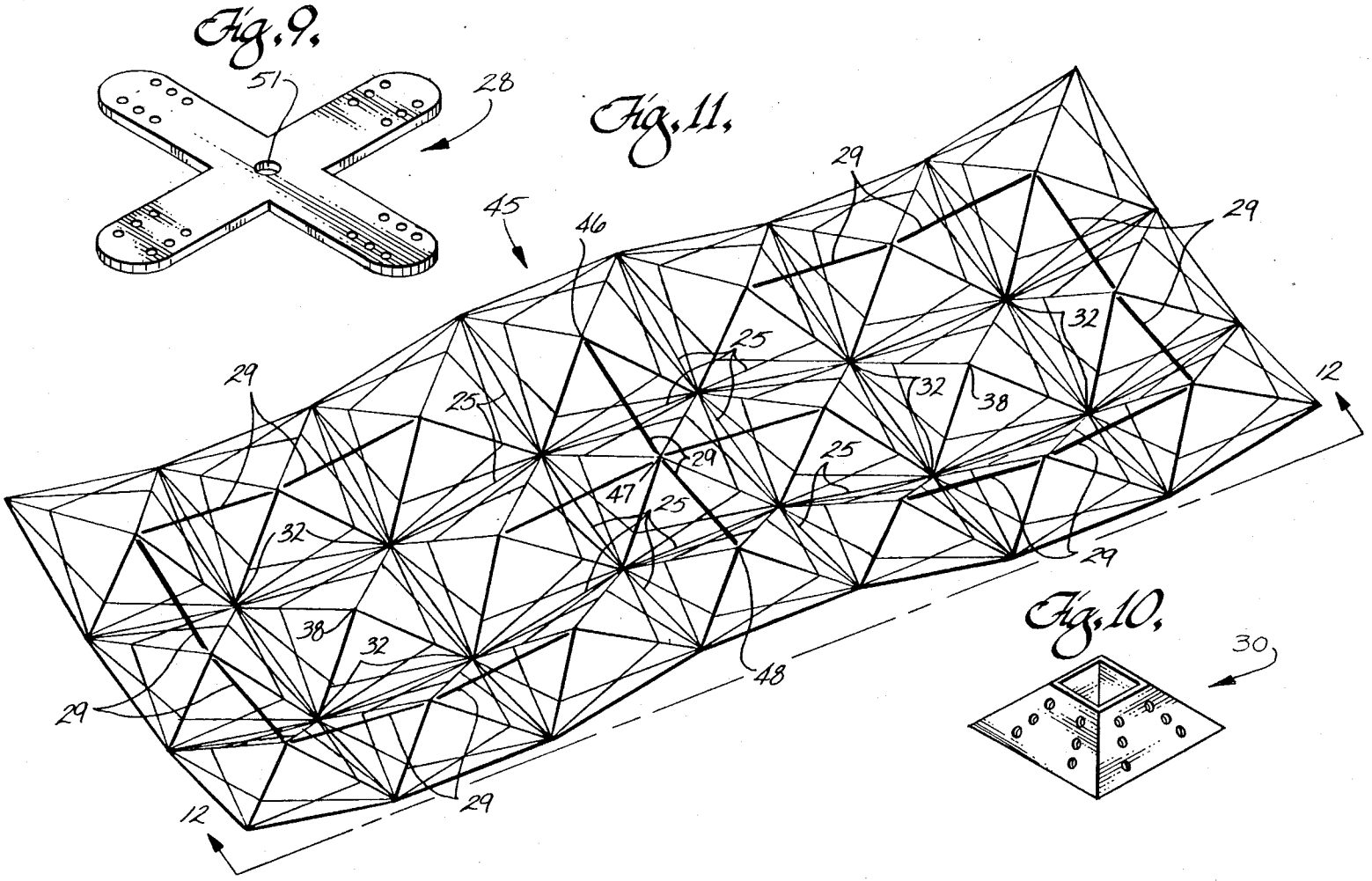
FIG. 9 is a perspective view of a basal end connector useful with units of the kind shown in FIG. 5.
FIG. 10 is a perspective view of an apical end connector useful with struts of the kind shown in FIG. 8.
FIG. 11 is a perspective view of another roof structure.

Cruciform connector fittings 28 (see FIG. 9) are used to connect the basal corners of saddles 12 and half-saddles 13 in roof 10. The material of these latter elements adjacent their basal corners is drilled as desired to match the pattern of bolting holes provided in fittings 28. Also, some of the saddles in roof 10 cooperate adjacent their apical corners with rigid struts 29, shown in FIG. 8. The struts are configured to be bolted or riveted to a saddle. It is preferred that where the struts are used, they are used in combination with apical connector fittings 30 which are in the form of truncated hollow pyramids which are suitably drilled, as are the pertinent saddle apical areas and strut end configurations, in a desired pattern. Fittings 30 are used with the saddle apical areas between them and the struts.

Whether and how many struts 29 are used in a roof according to this invention depends principally upon the nature and location of supports for the roof, and also upon the overall curvature of the roof; it is known that a curved roof has greater inherent strength than a flat roof. There is a minimum number of struts needed in a given roof for a particular number of support locations. If struts are used, they are not used to interconnect every pair of pyramids in the roof.

Roof 10 is assembled from twelve full saddles 12 and twelve half saddles 13. Because roof 10 has overall spherical curvature, as noted above, the various full and half-saddles are not identical, but rather are formed with dimensional differences consistent with geometric similarity. The full and half-saddles are assembled to form a roof having a square plan outline (see FIG. 2) and four support locations 32. The support locations are located at the corners of a square pattern on the diagonals of the roof plan outline approximately one-third the distance from the center of the roof toward its corners. The full and half-saddles are assembled in a predetermined relation to each other to define a group of nine four-sided pyramids, each of which has a substantially square base plan outline. Such assembly is accomplished via flanges 26 along the connection edges 15 of the saddles and via basal corner connection fittings 28. The locations of the apices of the nine pyramids of roof 10 are denoted in FIGS. 1–4 as locations 34–42. The intersections between adjacent pyramids in the roof correspond to the position on the roof of the ribs 25 which extend between the basal corners of the full saddles. As will be seen from FIG. 2, the ribs are arranged to form a square in the center of the roof and extensions of the sides of that square to the perimeter of the roof, thus dividing the roof area into nine cells each of which contains a single pyramid.

Examination of FIGS. 1–4 also shows that pyramid apices 35, 37, 39 and 41 are located in a common plane above the apex 38 of the center pyramid, and that pyramid apices 34, 36, 40 and 42 are located in a common plane parallel to and above the plane of apices 35, 37, 39 and 41. The several pyramid apices define points on the surface of a sphere. Thus, the bases of the pyramids surrounding the center pyramid lie in respective planes which are inclined by varying degrees to the plane of the base of the center pyramid, as shown best in FIGS. 1 and 3. It is within the scope of this invention, however, that the base planes of the several pyramids of roof 10 can all lie in a common plane, so that the overall curvature of the roof is flat, i.e., infinite radius of curvature.

FIGS. 1–4, 11–12, and 13, respectively, illustrate three different roof structures 10, 45, and 50 which are related to each other in that they are all defined by interconnected pyramids having square bases and formed by the interconnection of appropriate numbers of suitably configured full and half-saddles 12 and 13 as described above. Roofs 45 and 50 use multiples of a multi-pyramid module which occurs once in roof 10; roof 50 also involves multiple use of a different multi-pyramid module which occurs once in a roof 45; these modules are defined only by full saddles 12. In each of roofs 10, 45 and 50, half-saddles 13 are used only around the perimeter of the roof to give the roof a substantially straight edge line.

The multi-pyramid module, a primary module, which occurs in each of roofs 10, 45 and 50, is that portion of roof 10 which is defined by all of the full saddles in that roof and which is centered on support points 32. That module is used two times in roof 45 and four times in roof 50. In each instance the module is centered on a group of four roof support points 32. The other module, a connection module, is comprised of those remaining full saddles of roof 45 which do not comprise either of the primary modules, i.e., those full saddles which cooperate to define in roof 45 the pyramids having apices 46, 47 and 48 shown in FIG. 11. Four connection modules are used in combination with four primary modules to define the major portions of roof 50, the center of which is closed by four full saddles cooperating to define a central pyramid having apex 51.

In each connection module the base of the central pyramid, that one having apex 47, lies in a horizontal plane above the base of the central pyramid in each adjacent primary module. The pyramid apices 46 and 48 are located above apex 47.

Figure 1:
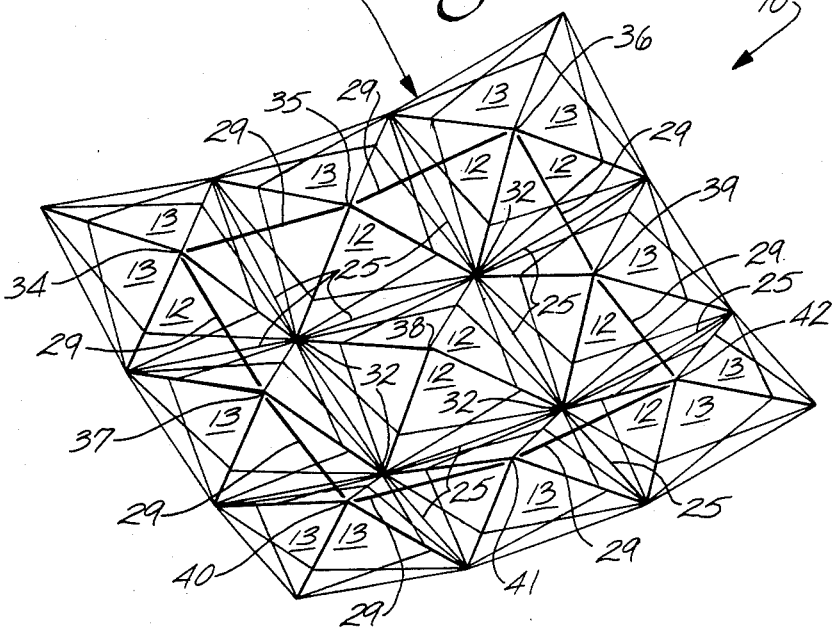
FIG. 1 is a top perspective view of a roof structure according to this invention.
Figure 2:
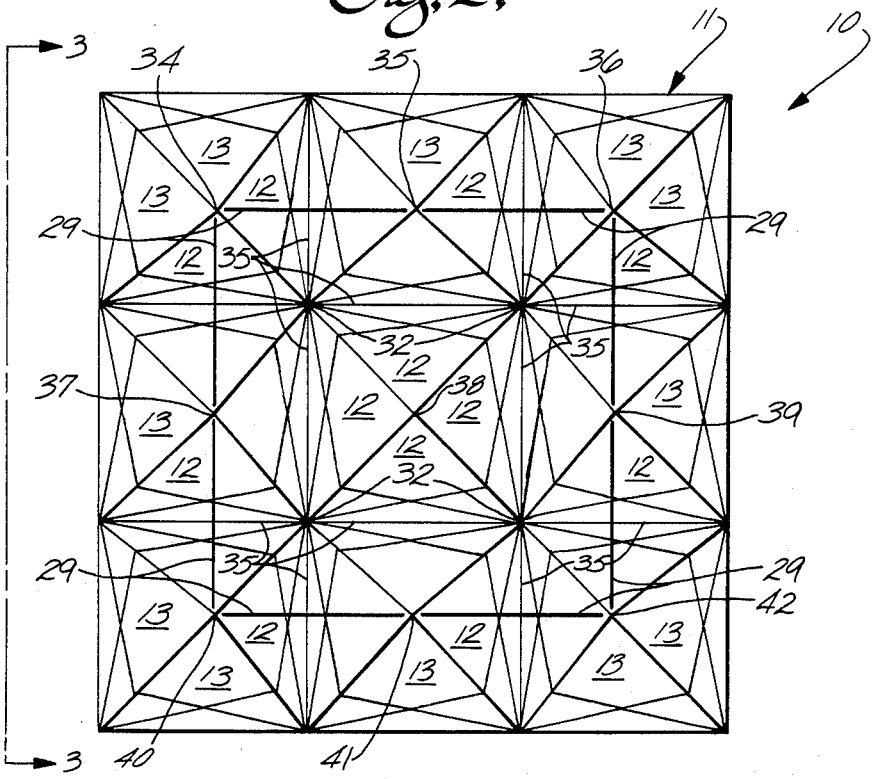
FIG. 2 is a top plan view of the roof structure shown in FIG. 1.
Figure 18:
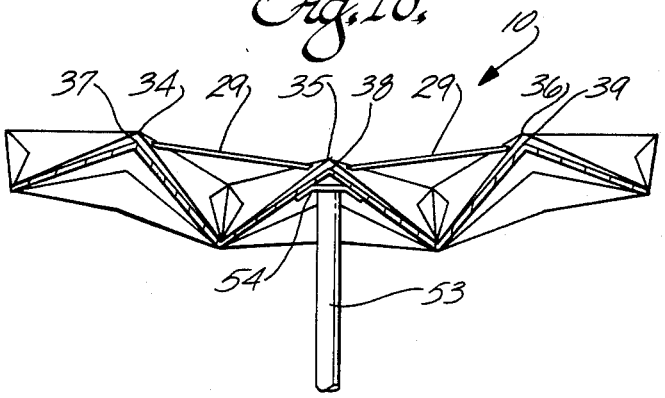
FIG. 18 is an elevation view of a roof structure generally of the style shown in FIG. 1 having a different support arrangement.

FIGS. 1–4, 11–12 and 13 illustrate two things, namely, that the present invention is versatile and enables the construction of a roof of virtually any perimeter configuration desired, and that the extent to which interpyramid struts 29 are required is a function of the nature and location of the support of the roof. In roof 10, a strut is connected between the apices of each adjacent pair of pyramids other than the central pyramid in that roof. In roof 45, however, there are no struts between the pyramids adjacent the connection module, but struts are connected between the pyramids of the connection module, i.e., between pyramids 46–47 and 47–48. This difference shows how the connection module imparts stability and support to the adjacent primary modules. This principle is further illustrated in the strutting of roof 50 in which the number of struts in each primary module is reduced to four (versus eight in the instance of one primary module alone as shown in FIG. 1). Thus, where a primary module cooperates along one side thereof with a connection module, which is itself strutted, the struts between the pyramids along that side of the primary module can be deleted. For example, if according to this invention there were constructed a roof structure comprised of nine primary modules in a $3\times3$ array, the central primary module in that array could be entirely unstrutted if it is otherwise supported as shown in FIGS. 4 or 18, for example.

Figure 12:
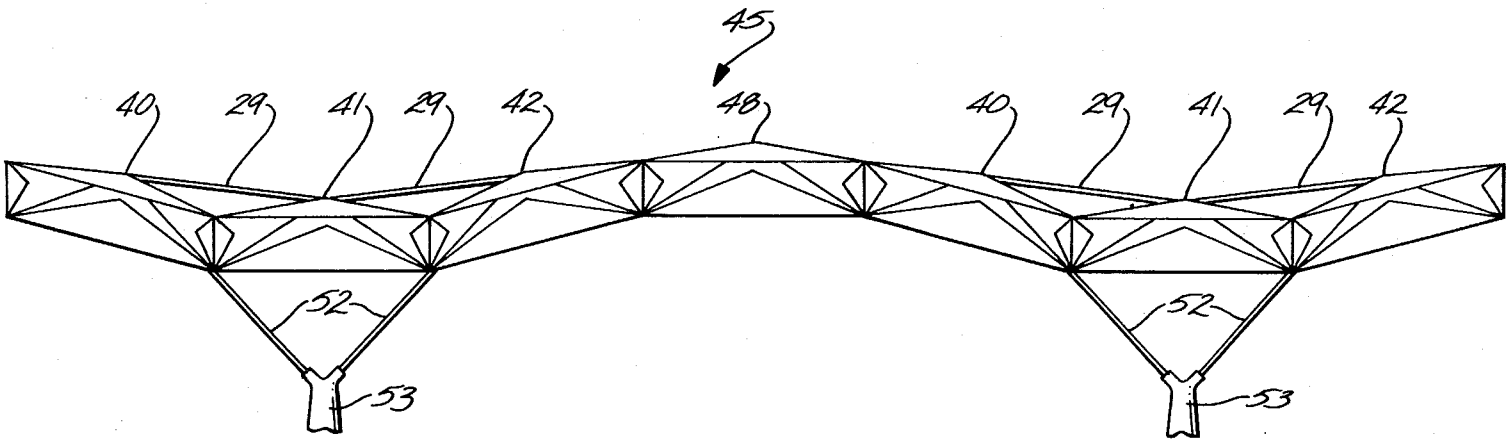
FIG. 12 is a side elevation view taken along line 12—12 in FIG. 11.
Figure 13:
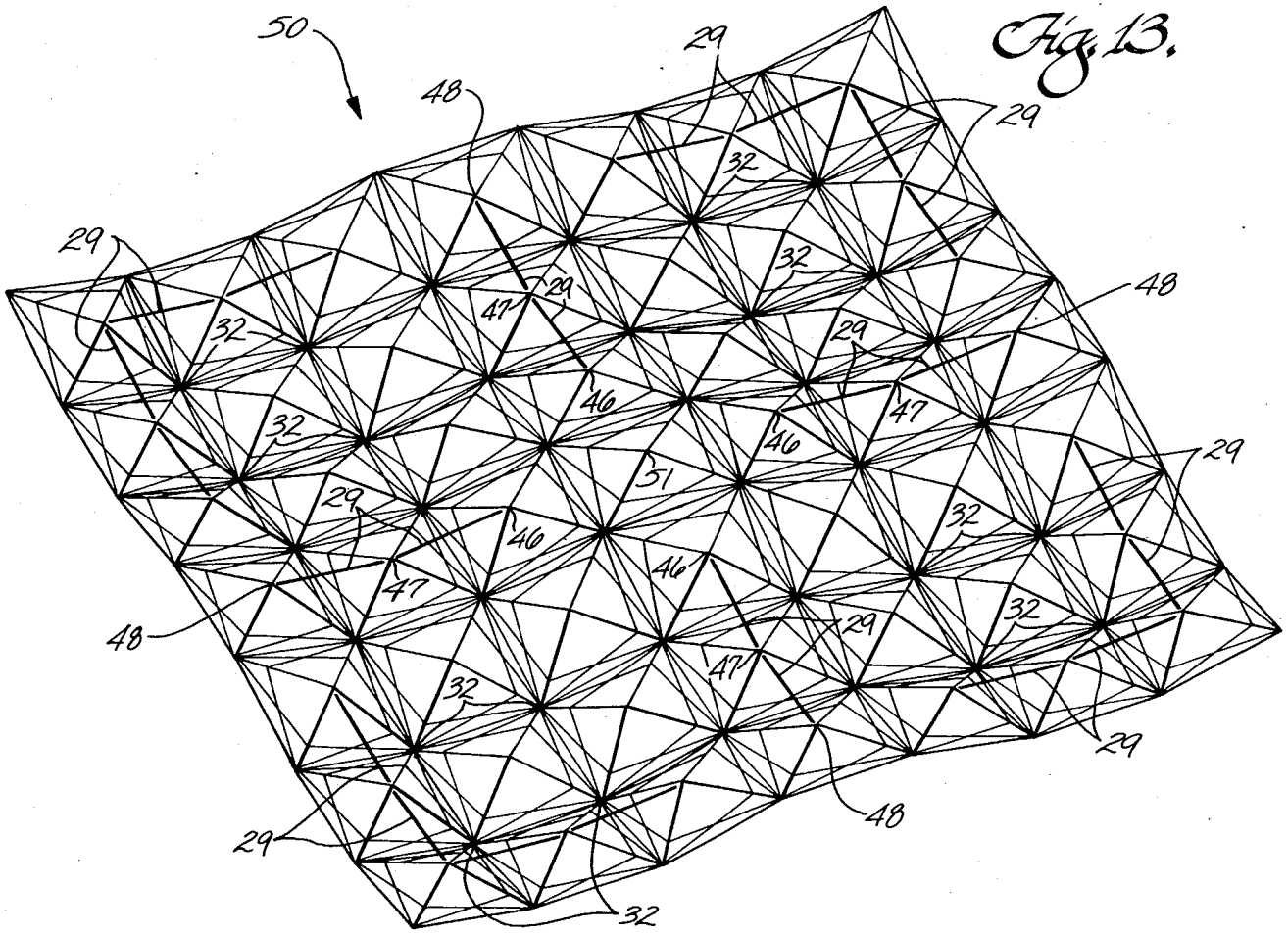
FIG. 13 is perspective view of a further roof structure.

Spherical curvature, or spherical and circular curvature, is present in roofs 10, 45 and 50 to impart added strength to each roof without addition of construction material. Such curvature is concave upwardly from the roof, but the same strengthening effects would result were the curvature concave downwardly from the roof. Concave upward curvature is preferred in combination with roof supports 52 as shown in FIGS. 3 and 12 for purposes of conveniently draining rainwater from the roof. Rainwater drains, via the valleys of the several saddles, into the valleys around the bases of primary module central pyramids 38, and thence downwardly through central openings 51 in basal connector fittings 28 into hollow tubes which preferably form roof supports 52. The lower ends of the support tubes discharge water into a down spout incorporated into a suitable pylon or pedestal 53 to which the support tubes are fixedly mounted, as shown in FIG. 3, so that roof support points 32 are fixedly defined in turn.

Other arrangements for supporting a present roof structure can be used if desired. For example, FIG. 18 shows a support arrangement for roof 10 which is alternate to that shown in FIG. 3 and in which the roof is supported adjacent the apex of pyramid 38 via a suitable bracket 54 carried at the upper end of a column 55. Where such apical support of the roof is used, it may be preferred to define the roof with concave downward curvature if drainage of rainwater is a consideration. Obviously, in that event, the several full and half saddles would have different detail geometric properties and struts 29 would be longer.

It was noted above that there is a relationship between the number of struts 29 required in a roof according to this invention and the nature and location of the supports for the roof. The preferred nature of the supports is a fixed support. In roof 10, the connection of supports 52 to common pedestal 53 must be a rigid connection. In roof 45, the roof can be strutted as described and as shown if the spacing of the set of the support locations for one primary module from the set of the support locations for the other primary module is a fixed spacing. However, if one set of support locations can move relative to the other set, then two additional struts should be provided in roof 45 between the apex of the central pyramid of the connection module and the adjacent faces of the saddles defining the central pyramid of the connection module. The strutting of roof 50 as described and as shown presumes that the several sets of primary module support locations 32 are fixed relative to each other.

When a minimum number of simple supports are used with a roof according to this invention, the minimum number of struts required equals the number of edge basal points less four. The most effective strut distribution over the roof will depend upon the total roof plan and the placement of the support locations. As the quantity of support locations is increased, the number of struts can be reduced; compare roof 70 shown in FIG. 19. The extent of strut reduction realizable depends upon the degree of support and the fixity provided by each support. If a sufficient number of supports are provided at the proper places, as in roof 70, all struts can be eliminated.

Figure 14:
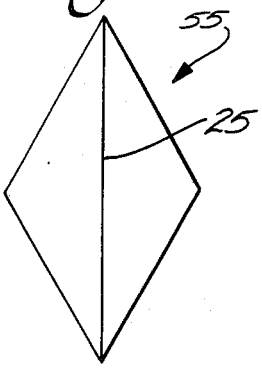
FIGS. 14 through 17 are simplified top plan views of other saddle-like units which can be used in a roof structure according to this invention.
Figure 15:
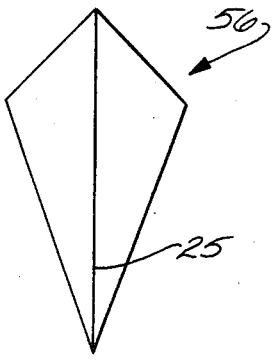
Figure 16:
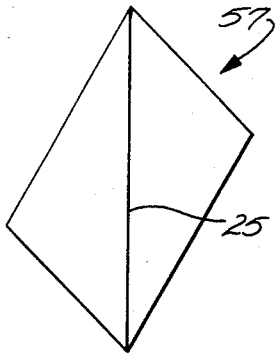
Figure 17:
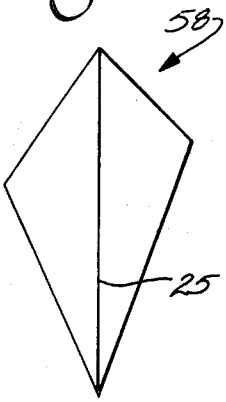

It was noted above that the precise planform shape of a saddle or a half-saddle unit is not a theoretical limitation on the practice of this invention. The essential requisites of a saddle useful in this invention are that the saddle have four corners, four substantially straight edges between corners, and an overall configuration which approximates that of a mathematical saddle. The pyramid base outlines are to have at least four sides. Thus, there may be doubly symmetric rhombical saddles 55 of which a square is special case (see FIG. 14), singly symmetric kite-shaped saddles 56 (see FIG. 15), parallelogram saddles 57 (see FIG. 16), or saddles 58 which have no edges of equal length (see FIG. 17). Regardless of its shape, a saddle element in a roof according to this invention is connected at a basal corner to no more than three other saddle elements.

Figure 19:
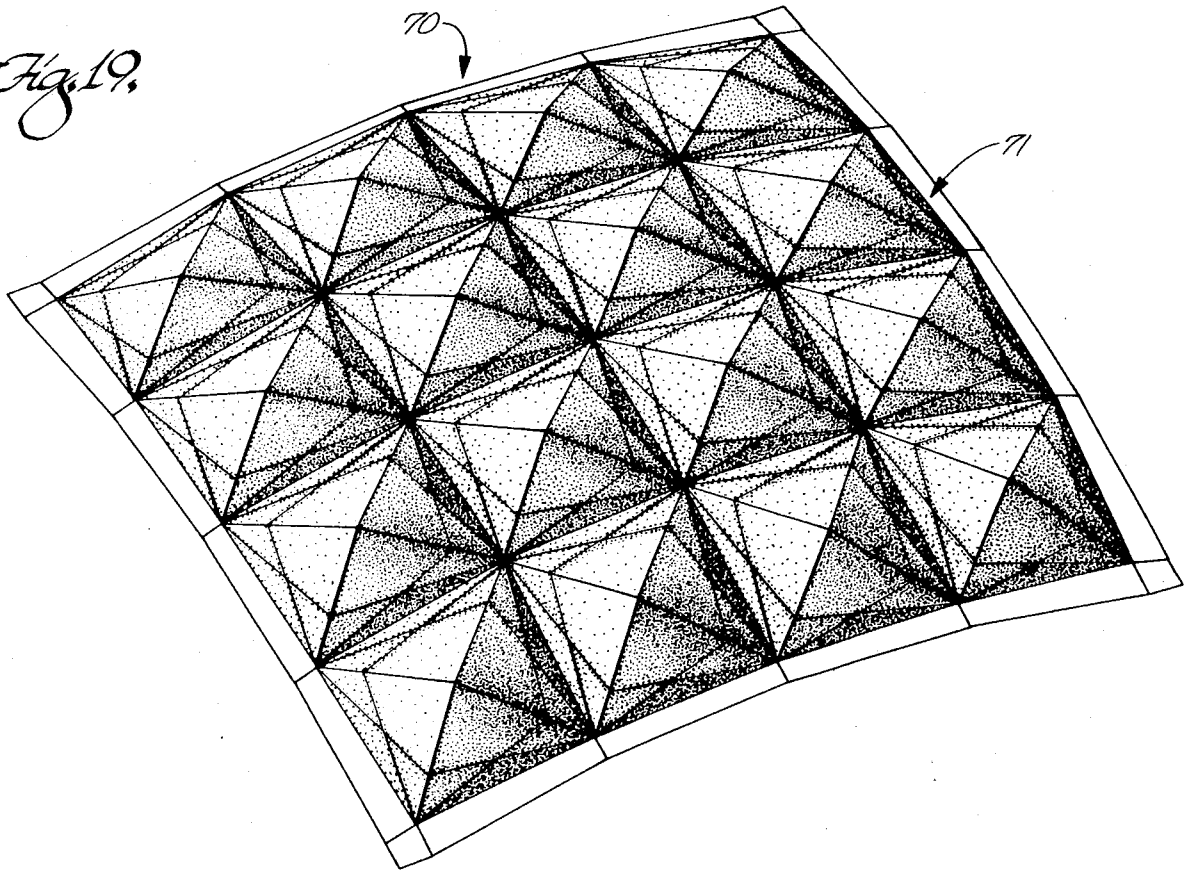
FIG. 19 is a perspective view of yet another roof structure incorporating the advances of this invention.

FIG. 19 depicts another roof structure 70 according to this invention. Roof 70 is fully unstrutted and is composed of pyramids having four-sided bases. The pyramids are defined by geometrically similar full and half saddles of suitably related detail dimensions and contour which are interconnected in predetermined relations. Roof 70 is supported by a peripheral load-carrying frame 71 which is in turn supported in any effective way desired. Roof 70 has overall spherical curvature concave downward. Roof 70 can be made virtually flat with just sufficient camber to provide drainage and remain a stable structure. Roof 70 further illustrates the point that the need for struts between the apices of some but not all adjacent pyramids in a roof according to the invention is related to the nature of the support provided for the roof and to where such support is provided.

Aluminum is the presently preferred material from which to fabricate the four-cornered, three-dimensional saddle-like structural units, and also the three-cornered half-saddle units, used in the construction of a roof according to this invention. Other metals can be used, as can other materials such as synthetic resin plastic materials as well as concrete.

The foregoing description of the principles, characteristics, and features of this invention have been presented with reference to certain preferred embodiments of the invention, among which the embodiments represented by roof structures 10, 45 and 50 are presently most preferred. The described embodiments are illustrative of the scope and content of this invention and are not exhaustive of all forms in which the invention can be embodied, and persons skilled in the art to which the invention most closely pertains will recognize such to be the case. Thus, the foregoing description is not to be read as limiting the invention only to the specific structures described, but rather is to be read consistent with the full and fair scope of the invention and its significance in the art and science to which it pertains.

What is claimed is:

1. A roof structure of the canopy type comprising:

(a) a plurality of at least twelve saddle-like three-dimensional four-cornered structural units, each having a first axis extending along a basal diagonal between non adjacent basal corners and lying along a valley dividing the unit into two substantially triangular portions, each unit having peripheral connection edges extending between adjacent corners which include nonadjacent apical corners at the ends of an apical diagonal and spaced from the valley at the tips of the triangular portions, the corners of each unit being disposed out of a common plane, the apical and basal diagonals having substantially different curvature with the apical diagonal being curved more than the basal diagonal sufficiently that when a central pyramid is formed by four of such units, the uncommon apical corners of the four units not connected to define the central pyramid are not coplanar with the basal corners of such units;

(b) the saddle-like units being connectable to each other along their connection edges in a predetermined relation to define at least a canopy principal module composed of twelve of the units forming (1) a central four-sided pyramid having faces defined by the triangular portions of four of the units and a quadrilateral base and (2) portions of eight additional similar pyramids contiguous to the central pyramid and each having at least two faces defined by triangular portions of the twelve units, and in which all apical corners of the twelve units of each principal module are disposed at the apices of pyramids in the module, and further in which the four units forming the faces of the module central pyramid also form faces of four of the additional pyramids having base edges common to base edges of the central pyramid; and (c) support means connectible to the roof structure at selected points for supporting the same.

2. A roof structure according to claim 1 wherein each pyramid has a substantially square base.

3. A roof structure according to claim 1 wherein each saddle-like unit is configured so that it is substantially symetrical about its first axis.

4. A roof structure according to claim 3 wherein each saddle-like unit is configured so that it is substantially symetrical about a line between its apical corners.

5. A roof structure according to claim 1 including a plurality of half-saddle units connected to the saddle-like units and to each other to form further sides of some of the pyramids, each half-saddle unit being structurally and geometrically similar to one triangular portion of a saddle-like unit and having two basal corners and an apical corner.

6. A roof structure according to claim 1 wherein each pyramid has a planar base, and the bases of the pyramids are not coplanar.

7. A roof structure according to claim 6 wherein the apices of some of the pyramids are disposed to lie on the surface of a sphere.

8. A roof structure according to claim 7 wherein the sphere is curved concave downwardly of the roof structure.

9. A roof structure according to claim 8 wherein the support means is connectible to the roof structure at selected points along a perimeter of the roof structure.

10. A roof structure according to claim 9 wherein the support means comprises a frame circumferentially of the roof structure and connected to it.

11. A roof structure according to claim 7 wherein the sphere is curved concave upwardly of the roof structure.

12. A roof structure according to claim 11 including inelastic strut means connectible between selected, but not all, adjacent pairs of pyramids adjacent their apices.

13. A roof structure according to claim 6 wherein the support means is connectible to the roof structure adjacent the apex of at least one pyramid.

14. A roof structure according to claim 13 wherein the support means is connectible to the inside of said at least one pyramid adjacent the apex thereof.

15. A roof structure according to claim 6 wherein the support means is connectible to the roof structure substantially at the corners of the base of at least one pyramid.

16. A roof structure according to claim 1 including strut means connectible to the roof structure at selected points for inelastically tying together selected, but less than all, adjacent pyramids adjacent their apices.

17. A roof structure of the canopy type comprising:

(a) a plurality of saddle-like three-dimensional four-cornered structural units, each unit having a first axis extending along a basal diagonal between non-adjacent basal corners and lying along a valley dividing the unit into two substantially triangular portions, each unit having peripheral connection edges extending between adjacent corners, each unit having nonadjacent apical corners at the ends of an apical diagonal and spaced from the valley at the tips of the triangular portions, the corners of each unit being disposed out of a common plane, the apical and basal diagonals having substantially different curvature with the apical diagonal being curved more than the basal diagonal;

(b) a plurality of half-saddle units, each being structurally and geometrically similar to one triangular portion of a saddle-like unit and having two basal corners, an apical corner, and connection edges between the apical corner and each basal corner;

(c) the saddle-like units being connectible to each other along their connection edges in a predetermined relation in at least nine interconnected groups of four units per group in which there are at least two saddle-like units per group, and each saddle-like unit in a group is also a member of a different one of the groups, the units in each group being configured so that, upon connection of the units, lines between adjacent basal corners define at least nine quadrilaterals arranged at least in a 3 by 3 matrix and each quadrilateral is the base of a four-sided pyramid having an apex formed by the interconnection of the apical corners of at least two of the saddle-like units; and (d) support and strut means connectible to the roof structure at selected points for supporting the same and for inelastically tying together selected, but less than all, adjacent pyramids at their apices.

18. A roof structure according to claim 2 in which a basal corner of any unit is connected to the basal corners of no more than three other units.

19. A roof structure according to claim 18 wherein each of the interconnected nine groups of units define a module comprised of twelve saddle-like units interconnected along their connection edges and having their basal corners disposed below their apical corners and arranged to define four spaced points in a common plane at each of which points four of the saddle-like units effectively intersect, the apical corners of adjacent ones of the twelve saddle-like units effectively intersecting at the apices of the nine pyramids in the module.

20. A roof structure according to claim 19 wherein said the apices of the pyramids in the module lie on an imaginary spherical surface.

21. A roof structure according to claim 20 wherein said imaginary spherical surface is curved concave upwardly from the module.

22. A roof structure according to claim 19 wherein said four points define the corners of a central pyramid in the module, and strut means connected between selected adjacent ones of the other eight pyramids in the module.

23. A roof structure according to claim 22 wherein strut means are connected between all adjacent ones of the other eight pyramids.

24. A roof structure according to claim 19 wherein said four points define the corners of a square.

25. A roof structure according to claim 19 wherein said four points comprise support points for the module.

26. A roof structure according to claim 19 wherein the module described in claim 19 is a first module, and wherein the roof structure also includes at least one second module comprised of a group of eight saddle-like units interconnected along their connection edges and having their basal corners disposed below their apical corners, the eight units in the second module cooperating to define one complete-four sided pyramid, three sides of each of two adjoining pyramids on opposite sides of the complete pyramid, and one side of each of six further pyramids disposed on opposite sides of the other pyramids and on the other opposite sides of the complete pyramid, and strut means connected between the apex of the complete pyramid and at the least adjacent face of each of the adjoining pyramids.

27. A roof structure according to claim 26 which includes at least two of said first modules and at least one of said second modules, one of said second modules being connected directly to and between each adjacent pair of the first modules via the connection edges of the saddle-like units in the respective modules.

28. A roof structure according to claim 27 wherein there are strut means connected between those of said other eight pyramids in each first module which are not adjacent to a second module.

29. A roof structure according to claim 27 wherein the base of each complete and of each partial pyramid in each of the first and second modules is substantially square.

30. A roof structure according to claim 27 wherein the bases of the several complete and partial pyramids in each module are disposed in other than a coplanar relation.

31. A roof structure according to claim 17 wherein the saddle-like and half-saddle units are fabricated of sheet metal, and wherein the connection edges of the units are defined by flanges formed integral with the units and via which each unit is connectible directly to another unit.

32. A roof structure according to claim 31 wherein each saddle-like unit is contoured along its first axis to carry tension and compression loads applied along such axis.

* * * * *